US006281858B1

(12) United States Patent
Jennetti et al.

(10) Patent No.: US 6,281,858 B1
(45) Date of Patent: Aug. 28, 2001

(54) HIGH PERFORMANCE, DIRECTIONAL CELLULAR BAND ANTENNA

(75) Inventors: Anthony G. Jennetti, Sunnyvale; Francisco J. Serrano, Los Gatos; Greg A. Manassero, San Jose; Ralph A. Belingheri, Woodside; Donald L. Rucker, Santa Cruz; Brent R. Humphrey, San Jose, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/447,166

(22) Filed: Nov. 22, 1999

(51) Int. Cl.[7] ..... H01Q 21/00
(52) U.S. Cl. ..... 343/818; 343/816; 343/795
(58) Field of Search ..... 343/818, 820, 343/821, 822, 823, 795, 793, 816; H01Q 21/00

(56) References Cited

U.S. PATENT DOCUMENTS 3,750,185 * 7/1973 Evans ..... 343/814
5,274,391 * 12/1993 Connolly ..... 343/820
5,481,272 * 1/1996 Yarsunas ..... 343/797
5,629,713 * 5/1997 Mailandt et al. ..... 343/808
5,691,735 * 11/1997 Butland et al. ..... 343/795
5,710,569 * 1/1998 Oh et al. ..... 343/817
5,724,051 * 3/1998 Mailandt et al. ..... 343/795

OTHER PUBLICATIONS

Huber+Suhner AG, Radio Transmission Department, Herisau, Switzerland, "The Suhner Planar Antenna For Wireless Communication In The 1.7–2.5 GHz Range."
Allen Telecom Group, Decibel Products Division, "DB781 MicroFill Indoor Antennas DB791 806–960 MHz."

* cited by examiner

*Primary Examiner*—Hoanganh Le
(74) *Attorney, Agent, or Firm*—Robert W. Keller

(57) ABSTRACT

An indoor cellular band antenna has an outer metal housing having a 90° inner configuration and a radome positioned over the front of the housing. An antenna dipole is mounted in the housing and includes two dipole members. Each dipole member includes a rectangular dipole element extended transmission balun members and a back mounting plate. An antenna cable extends through the top panel of the housing. An outer conductor of the cable is electrically connected to one of the transmission balun member of one dipole member and an inner conductor is electrically connected to the dipole element of the same dipole member. The inner and outer conductors of the cable are mounted to the dipole member by connectors formed from the dipole member.

21 Claims, 9 Drawing Sheets

HIGH PERFORMANCE, DIRECTIONAL CELLULAR BAND ANTENNA

BACKGROUND OF THE INVENTION

1. Field of the Invention

This invention relates generally to an antenna and, more particularly, to an indoor, low cost, high performance, directional cellular band antenna employing a 90° truncated reflector housing and rectangular dipole elements.

2. Discussion of the Related Art

Many types of communications antennas exist in the art. Each various antenna design must provide suitable performance at the particular bandwidths of operation. For cellular telephones, the antenna must effectively receive and transmit signals in the 800–1050 MHz range. Certain building materials may significantly attenuate cellular band signals, thus reducing the ability of the telephone to operate effectively indoors. Therefore, it may be desirable to provide a cellular band antenna within a room or interior space that it electrically connected to an exterior antenna to provide suitable operation of the cellular telephones within the space. Several different requirements drive the design of these types of antennas. These requirements include low cost, ease of manufacture and assembly, ease of installation, ability to be inconspicuously mounted in the space, high performance over the desired bandwidths, suitable front-to-back ratio (FBR), and reliability.

State of the art antennas of this type include triangular dipoles, 90E corner reflector antennas, and radome antennas such as the Allen MicroFill indoor antennas, Model Nos. DB781 and DB791, and the Suhner planar antennas, known to those skilled in the art. However, improvements can be made in the existing antenna art to provide an increase in one or more of the above-described desirable features. It is therefore an object of the present invention to provide an indoor antenna operable in the cellular band frequency range that includes significant improvements over the state of the art antenna designs.

SUMMARY OF THE INVENTION

In accordance with the teachings of the present invention, an indoor cellular band antenna is disclosed that is low cost, easy to manufacture and assemble, easy to install, and has better performance than the comparable antennas existing in the art. The antenna has an outer metal housing including angled side panels, trapezoidal-shaped top and bottom panels and a rectangular-shaped back panel defining a 90E truncated corner configuration. A radome is positioned over the front of the housing by sliding it beneath extended clips formed to the side panels. An antenna dipole is mounted in the housing and includes two dipole members positioned to be substantial mirror images of each other except for minor differences. Each dipole member includes a rectangular dipole element, an extended transmission balun member, and a back mounting plate. The transmission balun members are parallel to each other and are spaced apart a predetermined distance to provide electromagnetic coupling between the dipole members. An antenna cable extends through the top panel of the housing to be connected through a distribution system to an exterior antenna. An outer conductor of the cable is electrically connected to the transmission balun member of one of the dipole members and an inner conductor is electrically connected to the dipole element of the same dipole member. The inner and outer conductors of the cable are mounted to the dipole portion by connectors formed from the dipole member.

Additional objectives, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a cost effective, indoor cellular band antenna is merely exemplary in nature, and is in no way intended to limit the invention or its applications or uses. Particularly, the antenna of the invention will be described as an antenna useful for an interior space, such as a hotel room or office building, and operable at cellular telephone frequencies. However, the particular design and features of the antenna of the invention has a wider application for other types of antenna usages, and other cellular bands such as PCS and GSM.

Figure 1:
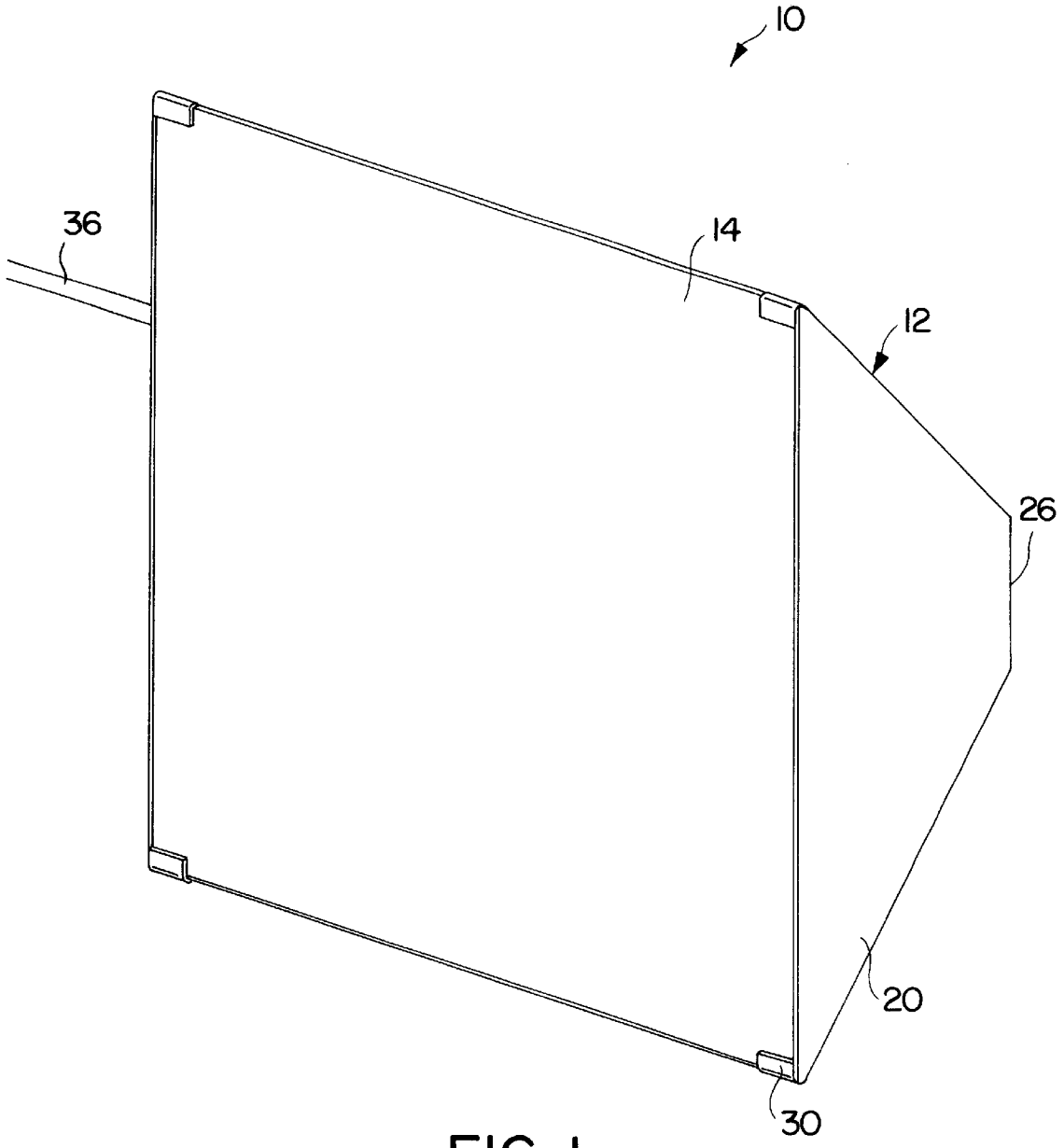
FIG. 1 is a perspective view of an indoor, cellular band antenna, according to an embodiment of the present invention.
Figure 2:
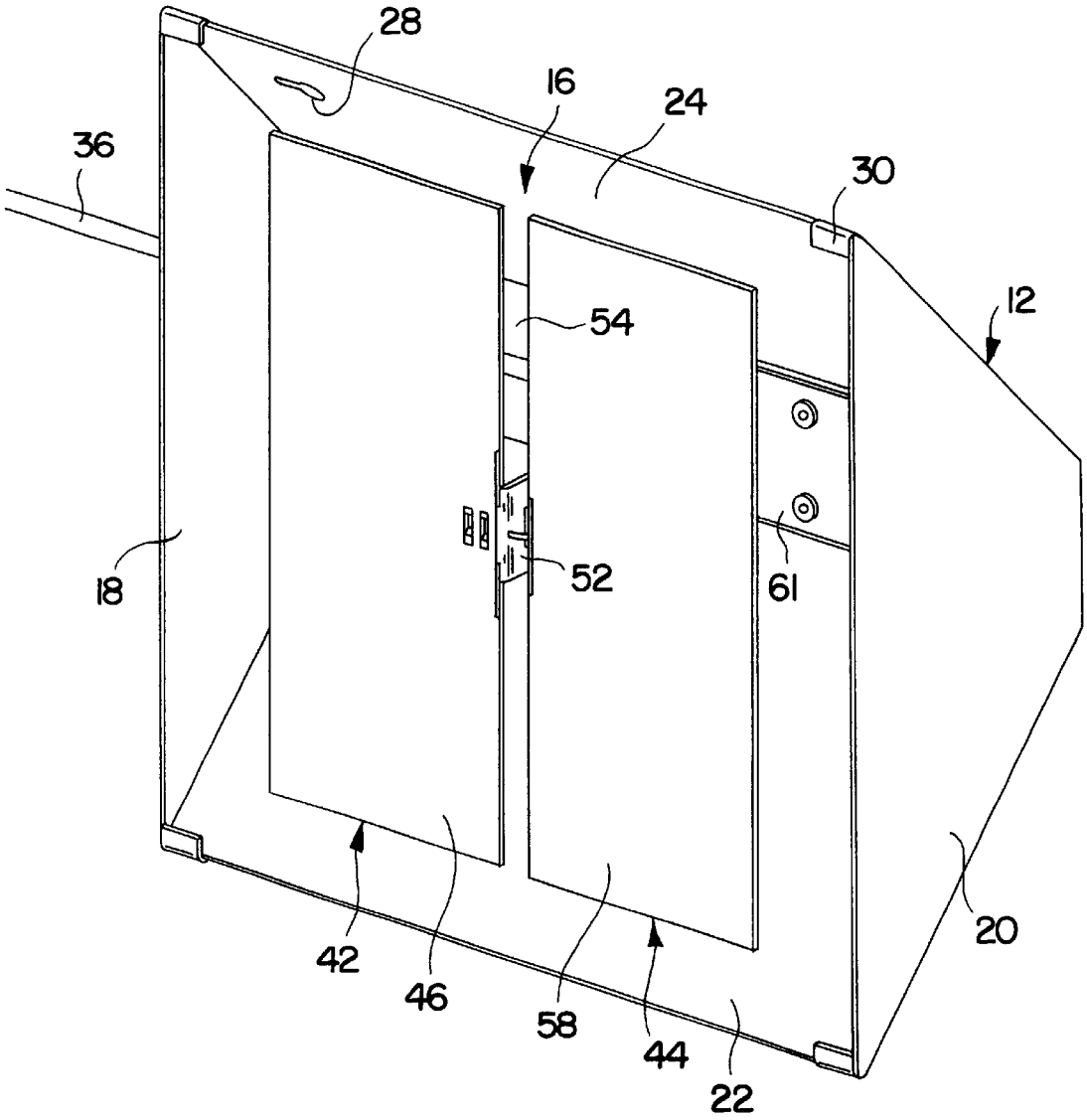
FIG. 2 is a perspective view of the antenna shown in FIG. 1 with the front cover removed.

FIG. 1 is a perspective view of a cellular band antenna 10, according to an embodiment of the present invention. The antenna 10 includes an outer metal housing 12 including a plastic cover or radome 14 that is transparent to the electromagnetic radiation of the wavelengths of interest. FIG. 2 shows the same perspective view of the antenna 10 as in FIG. 1, but with the radome 14 removed to expose an antenna dipole 16 within the housing 12. As will be discussed below, the antenna dipole 16 is a unique, cost effective antenna design that includes rectangular dipole elements for providing increased antenna performance, low cost, and ease of manufacture, as well as other advantages.

Figure 3:
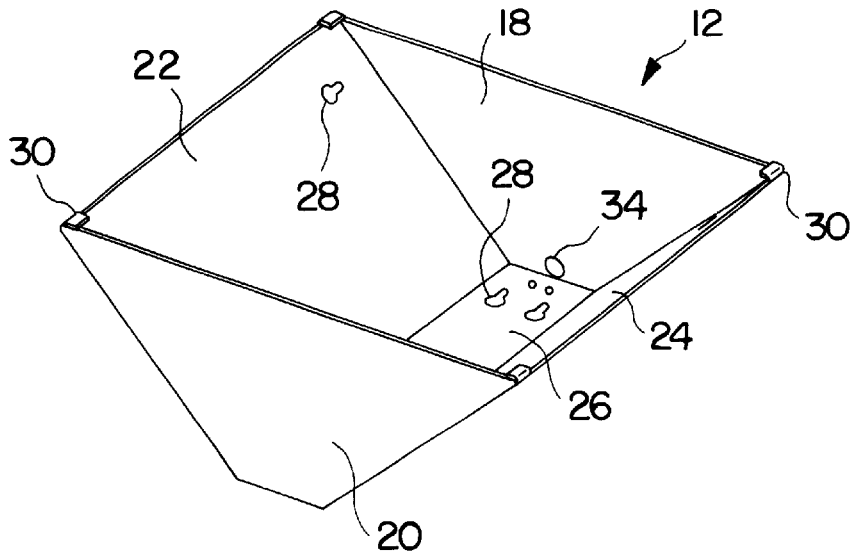
FIG. 3 is a perspective view of the housing of the antenna shown in FIG. 1 without the front cover.

FIG. 3 shows a perspective view of the housing 12 with the radome 14 and the antenna dipole 16 removed. The housing 12 includes opposing, trapezoidal-shaped top and bottom panels 18 and 20 and angled side panels 22 and 24 that extend from the radome 14 to a back panel 26, as shown. The combination of the side panels 22 and 24 and the back panel 26 define a 90E truncated corner configuration, in that if the back panel 26 was removed and the side panels 22 and 24 were extended, the side panels 22 and 24 would intersect at a 90E angle. The combination of the side panels 22 and 24, in combination with the top and bottom panels 18 and 20 and the back panel 26, reflect electromagnetic radiation towards the radome 14 to increase the antenna's front-to-back ratio (FBR).

Figure 4:
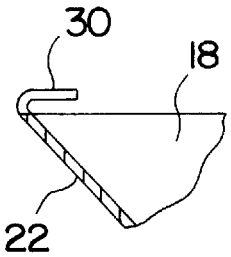
FIG. 4 is a cut-away view of a housing clip for holding the cover to the housing of the antenna shown in FIG. 1.

A series of specially configured mounting slots 28 extend through the back panel 26 and the side panels 22 and 24 so that the antenna 10 can be readily and easily mounted at an inconspicuous location in the corner of a room by screws, or the like. Four "J-shaped" clips 30 are formed in the side walls 22 and 24 at each corner of the radome 14, so that the radome 14 can be mounted to the housing 12 by sliding it between the clips 30 and the top and bottom panels 18 and 20. A close-up view of one of the clips 30 is shown in FIG. 4. A circular opening 34 is formed through the top panel 18 proximate the back panel 26 to allow a coaxial antenna cable 36 to extend into the housing 12 to be connected to the antenna dipole 16, as will be discussed in detail below. The housing 12 is formed by a cost effective metal rolling, cutting and/or punching process.

Figure 5:
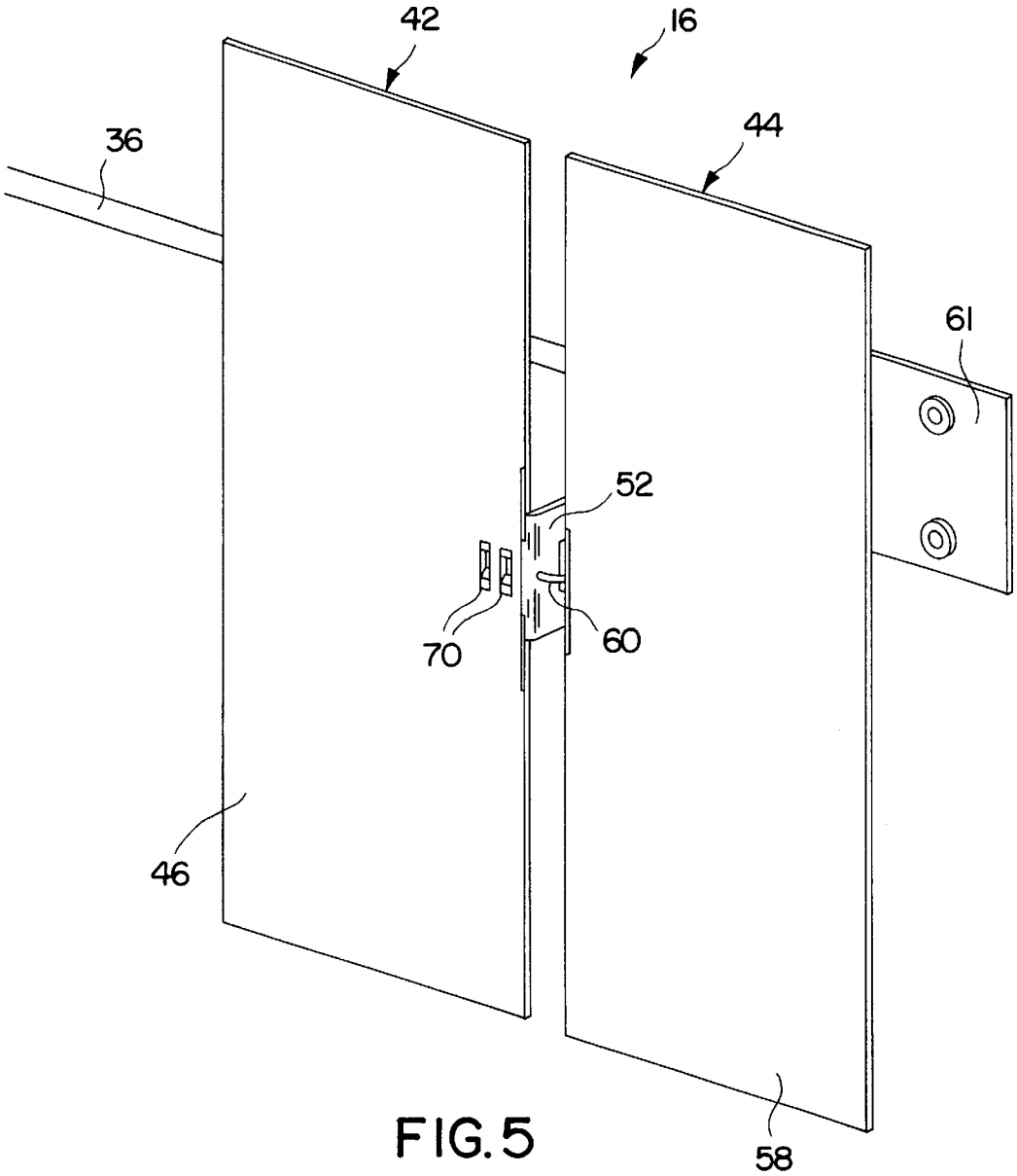
FIG. 5 is a front perspective view of an antenna dipole of the antenna, including two rectangular-shaped dipole elements, removed from the housing.
Figure 6:
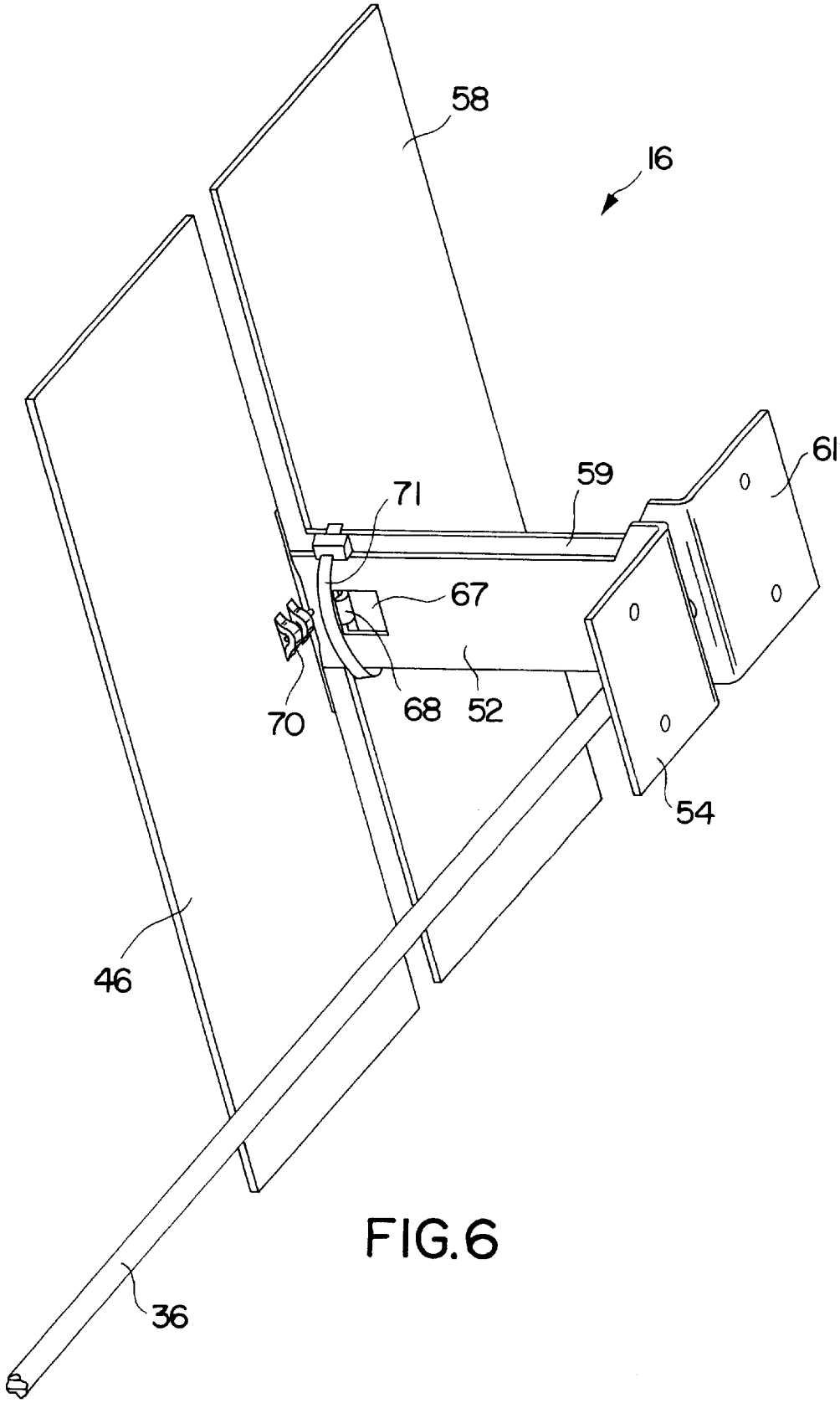
FIG. 6 is a back perspective view of the antenna dipole of the antenna shown in FIG. 5.
Figure 7:
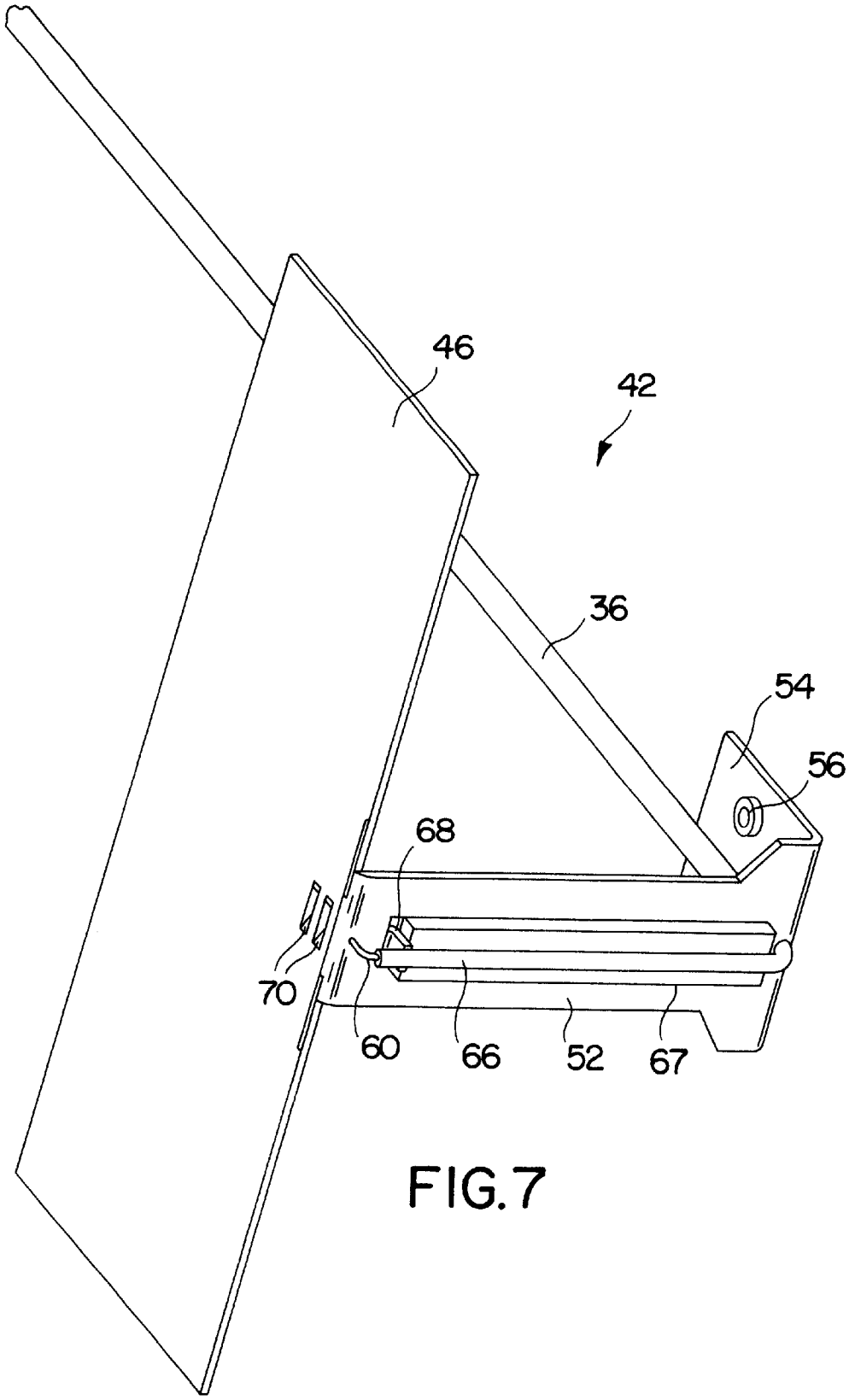
FIGS. 7–9 show three perspective views of one of the dipole members of the dipole shown in FIG. 5 depicting the connection of an antenna cable.
Figure 8:
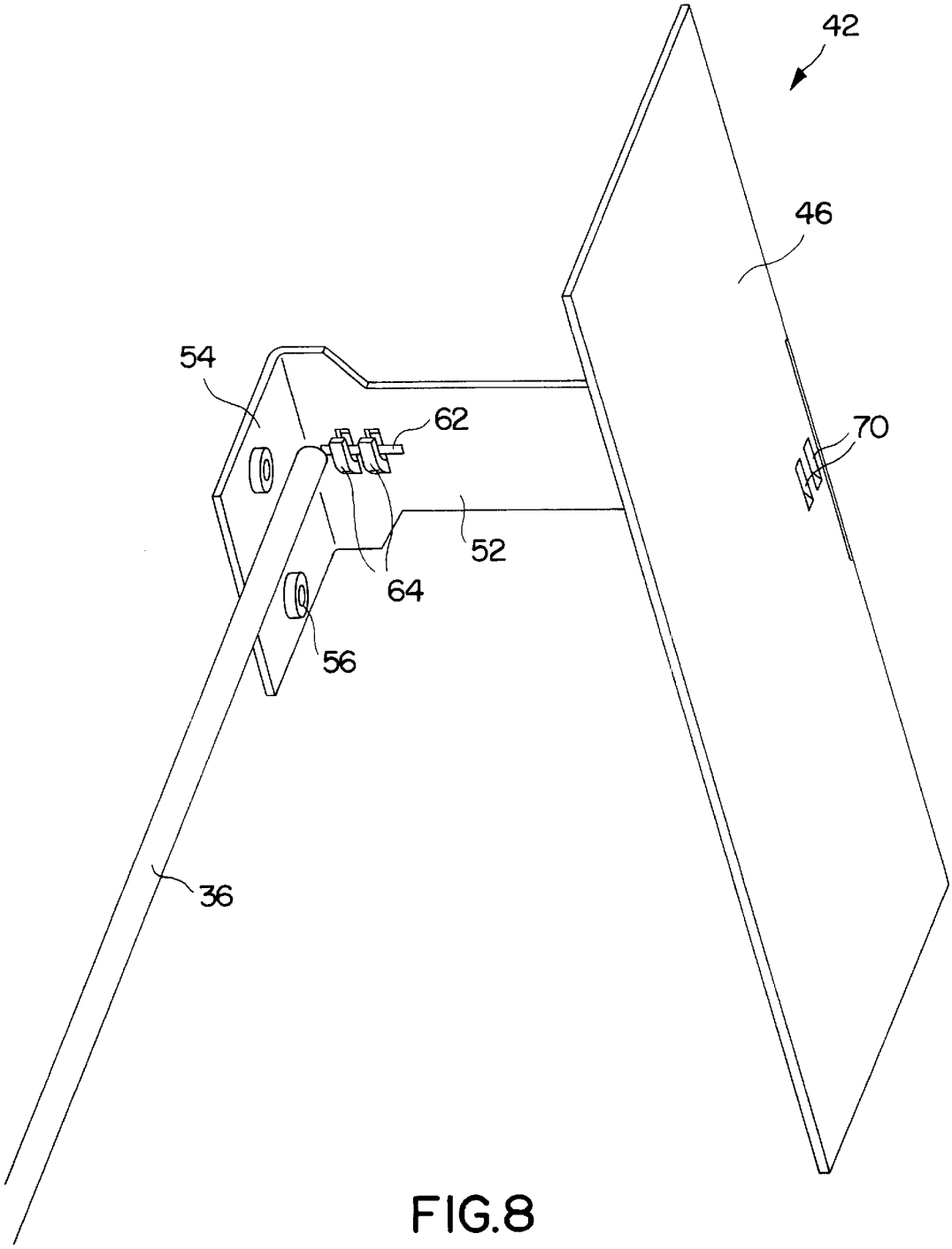
Figure 9:
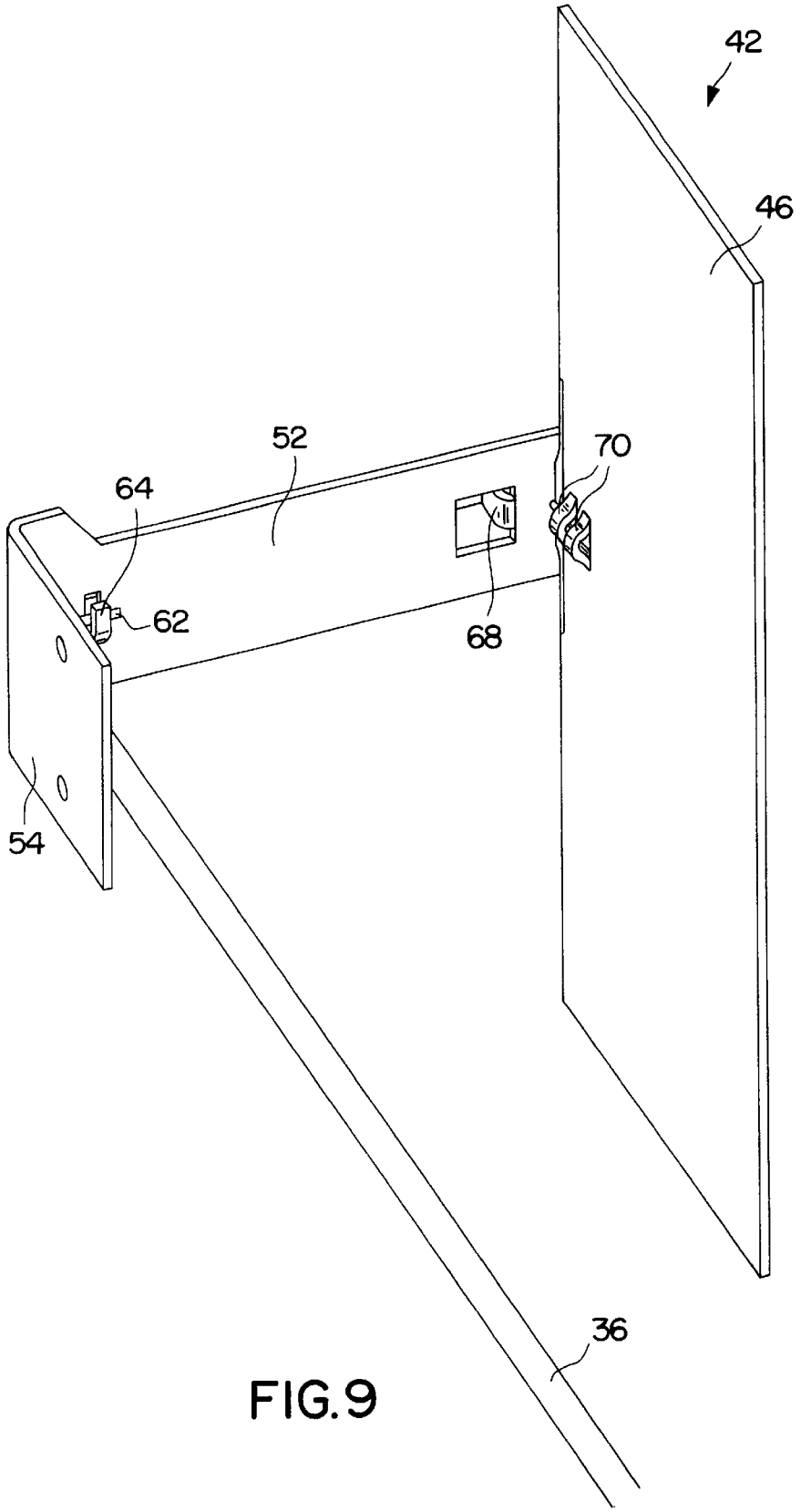
Figure 10:
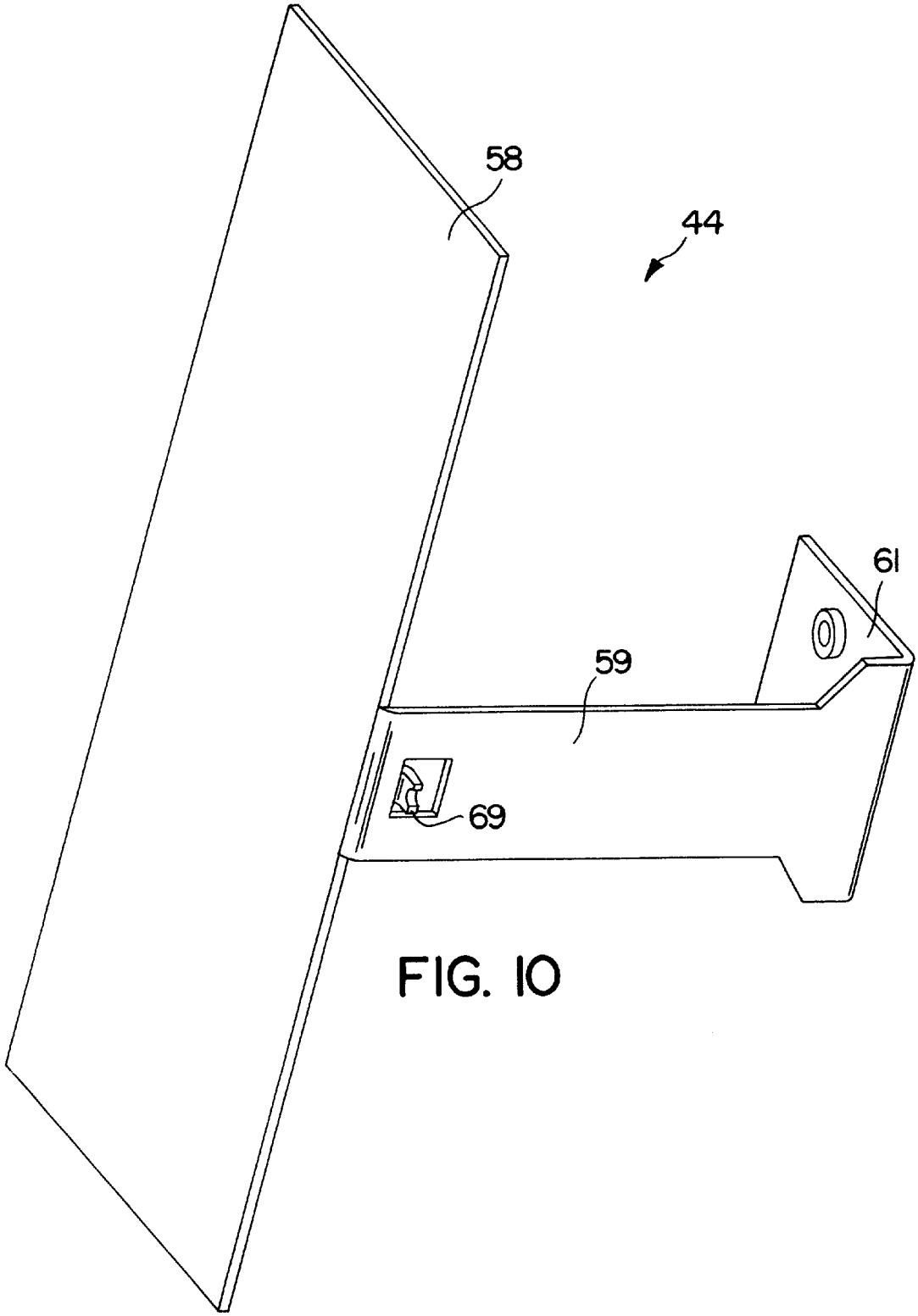
FIG. 10 is a perspective view of the other dipole member of the dipole shown in FIG. 5.

FIG. 5 shows a front perspective view and FIG. 6 shows a back perspective view of the antenna dipole 16 removed from the housing 12. The antenna dipole 16 includes a first dipole member 42 and a second dipole member 44. The dipole members 42 and 44 are mirror images of each other, except for minor differences apparent from the discussion and the figures. FIGS. 7–9 show different perspective views of the member 42 separated from the dipole 16 and connected to the cable 36. FIG. 10 shows a perspective view of the dipole member 44 separated from the dipole 16. The dipole member 42 includes a rectangular dipole element 46, an elongated transmission balun member 52 and a mounting base plate 54. The dipole element 46, the transmission balun member 52 and the base plate 54 are formed of a single piece of a conductive metal, such as aluminum, that has been bent and formed to the shape as shown. A pair of bolts 56 extend through the base plate 54 to mount the dipole member 42 to the back panel 26 in an electrical contact.

The dipole member 44 includes substantially the same components as the dipole member 42 including a rectangular dipole element 58, a transmission balun member 59 and a base plate 61. The dipole elements 46 and 58 are monopole elements when separated. The two dipole elements 46 and 58 are positioned in substantially the same plane, and are directed towards the radome 14. The two extended parallel transmission members 52 and 59 of the dipole members 42 and 44 form a balun. The members 52 and 59 are spaced apart from each other by a predetermined distance based on the frequency band of interest to provide electromagnetic coupling between the dipole members 42 and 44 and an electrical feed to the elements 46 and 58, as would be understood to those skilled in the art. The spacing between and configuration of the dipole members 42 and 44, and the shape of the elements 46 and 58 allow the antenna to operate at the bandwidth described herein with high performance.

Figure 11:
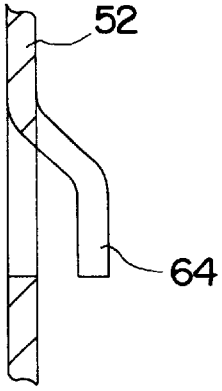
FIG. 11 is a cut-away, cross-sectional view of a punched-out clip used to hold an outer conductor of the antenna cable.

The cable 36 is connected to the dipole member 42, and is the feed to transmit electromagnetic radiation to the antenna 10 and for electromagnetic radiation received by the antenna 10. The cable 36 includes an inner conductor 60 and an outer conductor 62. The outer conductor 62 is electrically connected to the dipole member 42 by a pair of mounting tabs 64 punched from the transmission balun member 52 and formed, as shown. FIG. 11 shows a cut-away, cross-sectional view of one of the mounting tabs 64 without the outer conductor 62 mounted therein.

An insulating layer 66 between the inner conductor 60 and the outer conductor 62 extends through the balun member 52 and along its length between the balun members 52 and 59. A metal stand-off 68 formed from a cut-out section of the balun member 52 holds the inner conductor 62 and the insulating layer 66 of the cable 36 in place relative to the balun member 52. A foam spacer 67 is positioned between the balun member 52 and the inner conductor 62, as shown, to also hold the conductor 62 in the proper location. A metal stand-off 69 formed from a cut-off section of the balun member 59 also acts to provide appropriate spacing between the balun members 52 and 59. Additionally, a connecting strip 71, such as a Ty-Rap, can be wrapped around the balun member 52 to also provide dimensional integrity. The stand-off 68 and the spacer 67 are specially designed to position the inner conductor 60 at a desirable spacing between the balun member 52 of the dipole member 42 and the balun member 59 of the dipole member 44.

Figure 12:
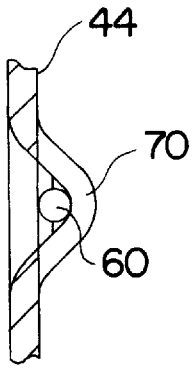
FIG. 12 is a cut-away, cross-sectional view of a portion of one of the dipole elements showing a punched-out connector for the inner conductor of the antenna cable.

The inner conductor 60 extends back through the balun member 52 and is electrically connected to the rectangular dipole element 46 by a pair of connectors 70 formed by punching out a portion of the element 46 as shown. FIG. 12 shows a cut-away cross-sectional view of one of the connectors 70.

The configuration and design of the antenna 10, as discussed above, provides a number of advantages for an antenna of this type in the prior art. Particularly, the antenna 10 is low cost, easy to manufacture, easy to assemble, simple to install, and provides superior electrical performance. The rectangular dipole elements 46 and 58 and the configuration of the antenna dipole members 42 and 44 provide high performance operation in the 800–1050 MHz range. The antenna 10 has an excellent gain of 8.0 dBi or greater, and an excellent front-to-back ratio greater than 25 dB in the range of 780–960 MHz and greater than 20 dB in the 960–1050 MHz range. Additionally, the antenna 10 has a 3 dB beam width azimuth plane of 70E–80E and a 3 dB beam width elevation plane at 55E–70E. The impedance is 50 ohms, the polarization is linear, and the VSWR over the 800–1050 MHz range is less than 1.5 of the antenna 10.

In one embodiment, for the above-described performance, the antenna 10 has the following dimensions. The radome 14 is a square 9 inches by 9 inches. The back panel 26 is centered and has a width of 1.7 inches. The clips 30 are 0.26 inches long and have a spacing of 0.07 inches. The perpendicular distance from the radome 14 to the back panel 26 is 3.625 inches. The dipole elements 46 and 58 are 7.1 inches long, 2.962 inches wide and 0.062 inches thick. The balun members 52 and 59 are 3.585 inches long and 1.0 inches wide at their narrowest point. The base plate 54 is 1.50 inches square. The clips 64 and 70 and the stand-off 68 are all centered relative to the width of the dipole element 46 and the width of the balun member 52, and are 3.55 inches from the top and bottom of the dipole element 46. The stand-off 68 extends 0.21 inches from the balun member 52, and has a width of 0.2 inches. The clip 70 is about 0.37 inches long and provides an opening for the inner cable 60 of about 0.07 inches. The clip 62 provides an opening of 0.09 inches.

The forgoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An antenna system comprising:

a housing, said housing having at least one housing panel defining a reflector;

a dipole antenna positioned within the housing, said dipole antenna including a first dipole member and a second dipole member that are electro-magnetically coupled together, said first dipole member including a first rectangular-shaped dipole element and said second dipole member including a second rectangular-shaped dipole element, where the first and second dipole members are positioned on substantially the same plane, said first dipole member further including a first transmission balun member; and a cable extending into the housing and being electrically connected to the first dipole member, wherein an outer conductor of the cable is electrically connected to the first transmission balun member and an inner conductor of the cable is electrically connected to the first dipole element.

2. The system according to claim 1 wherein the first dipole member includes a first mounting plate and the second dipole member includes a second transmission balun member and a second mounting plate, said first and second mounting plates being mounted to the housing, wherein the first and second transmission balun members are spaced apart a predetermined distance and are substantially parallel to each other, and wherein the first transmission balun member is substantially perpendicular to the first dipole element and the second transmission balun member is substantially perpendicular to the second dipole element.

3. The system according to claim 2 wherein the first dipole element, transmission balun member and mounting plate are formed of a single piece of metal, and the second dipole element, transmission balun member and mounting plate are formed of a single piece of formed metal.

4. The system according to claim 2 wherein the cable is mounted between the first and second transmission balun members.

5. The system according to claim 4 wherein the cable is mounted to the first dipole member.

6. The system according to claim 5 wherein the cable is connected to the first transmission balun member by a stand-off so as to separate the cable from the first dipole member, said stand-off being formed from the first transmission balun member.

7. The system according to claim 1 wherein the outer conductor of the cable is connected to the first transmission balun member by a punched-out section of the first transmission balun member and the inner conductor of the cable is connected to the first dipole element by a punched-out section of the first dipole element.

8. The system according to claim 1 wherein the housing includes first and second side panels that are angled relative to each other at about 90° and are connected to a rectangular-shaped back panel to form a truncated corner configuration.

9. The system according to claim 8 wherein the housing further includes trapezoidal-shaped top and bottom panels.

10. The system according to claim 1 wherein the housing further includes a front panel radome, said front panel radome being removably attached to side panels of the housing by extended clips.

11. The system according to claim 1 wherein the antenna system provides high performance reception and transmission in the 800 to 1050 MHz range.

12. An antenna for receiving and transmitting cellular-band frequencies, said antenna comprising:

a housing, said housing including angled side panels positioned at about 90° relative to each other, trapezoidal-shaped top and bottom panels, and a back panel defining a truncated corner configuration, said housing panels being an antenna reflector;

a first dipole member positioned within the housing, said first dipole member including a first dipole element, a first elongated transmission balun member connected to the first dipole element, and a first mounting plate connected to the first transmission balun member and the back panel, wherein the first transmission balun member is substantially perpendicular to the first dipole element;

a second dipole member positioned within the housing, said second dipole member including a second dipole element, a second elongated transmission balun member connected to the second dipole element, and a second mounting plate connected to the second transmission balun member and the back panel, wherein the second transmission balun member is substantially perpendicular to the second dipole element; and a coaxial cable extending through the housing, wherein an outer conductor of the cable is electrically connected to the first transmission balun member and an inner conductor of the cable is electrically connected to the first dipole element, said cable extending along the first balun member between the first and second balun members.

13. The antenna according to claim 12 wherein the first and second dipole elements are rectangular plates.

14. The antenna according to claim 13 wherein the first and second dipole elements are positioned on the same plane.

15. The antenna according to claim 12 wherein the first and second transmission balun members oppose each other and are substantially parallel.

16. The system according to claim 12 wherein the cable is connected to the first transmission balun member by a stand-off so as to separate the cable from the first dipole, said stand-off being formed from the first transmission balun member.

17. The system according to claim 12 wherein the outer conductor of the cable is connected to the first transmission balun member by a punched out section of the first transmission balun member and the inner conductor of the cable is connected to the first dipole element by a punched-out section of the first dipole element.

18. The system according to claim 12 wherein the housing further includes a front panel radome, said front panel radome being removably attached to side panels of the housing by extended clips.

19. A method of providing an antenna system, said method comprising the steps of:

providing a housing that includes at least one housing panel defining a reflector;

providing a dipole antenna having a first dipole member and a second dipole member where the first dipole member includes a first rectangular-shaped dipole element and a first transmission balun member and said second dipole member includes a second rectangular-shaped dipole element;

mounting the first dipole member and the second dipole member within the housing so that the first and second rectangular-shaped dipole elements are on substantially the same plane and the first dipole member and the second dipole member are electro-magnetically coupled together; and extending a cable into the housing and electrically connecting an outer conductor of the cable to the first transmission balun member and connecting an inner conductor of the cable to the first dipole element.

20. The method according to claim 19 wherein the step of providing a dipole antenna includes forming the first dipole member from a single piece of metal to include the first dipole element, the first transmission balun member and a first mounting plate, and forming the second dipole member from a single piece of metal to include the second dipole element, a second transmission balun member and a second mounting plate, and wherein the step of mounting the dipole antenna within the housing includes electrically connecting the first and second mounting plates to the housing so that the first and second transmission balun members are parallel to each other and define a balun.

21. The method according to claim 19 wherein the step of providing a housing includes providing a housing having first and second side panels that are angled relative to each other at about 90° and are connected to a rectangular-shaped back panel to form a truncated corner configuration.

* * * * *